US009331392B1

(12) United States Patent
Bermeo

(10) Patent No.: US 9,331,392 B1
(45) Date of Patent: May 3, 2016

(54) TAPERED SLOT ANTENNA WITH A CURVED GROUND PLANE

(71) Applicant: The United States of America as represented by the Secretary of the Navy, Washington, DC (US)

(72) Inventor: Dennis G. Bermeo, San Diego, CA (US)

(73) Assignee: THE UNITED STATES OF AMERICA AS REPRESENTED BY THE SECRETARY OF THE NAVY, Washington, DC (US)

( * ) Notice: Subject to any disclaimer, the term of this patent is extended or adjusted under 35 U.S.C. 154(b) by 208 days.

(21) Appl. No.: 14/063,001

(22) Filed: Oct. 25, 2013

Related U.S. Application Data

(63) Continuation-in-part of application No. 13/926,725, filed on Jun. 25, 2013.

(51) Int. Cl.
*H01Q 13/10* (2006.01)
*H01Q 13/08* (2006.01)

(52) U.S. Cl.
CPC ..... *H01Q 13/10* (2013.01); *H01Q 13/085* (2013.01)

(58) Field of Classification Search
None
See application file for complete search history.

(56) References Cited

U.S. PATENT DOCUMENTS 7,009,572 B1 3/2006 Homer et al.
7,148,855 B1 12/2006 Homer et al.
7,358,914 B1 4/2008 Horner
7,397,440 B1 7/2008 Horner et al.
7,408,521 B2 * 8/2008 Smith ..... H01Q 9/28 343/773
7,518,565 B1 4/2009 Horner et al.
7,592,962 B1 9/2009 Horner et al.
7,612,729 B1 11/2009 Horner et al.
7,679,574 B1 3/2010 Horner
7,679,575 B1 3/2010 Horner et al.
7,692,596 B1 4/2010 Horner et al.
7,701,406 B1 4/2010 Horner et al.
7,773,043 B1 8/2010 Horner et al.
7,782,265 B1 8/2010 Horner et al.
7,843,398 B1 11/2010 Horner
8,736,506 B1 * 5/2014 Brock ..... H01Q 1/283 343/786
9,077,080 B1 * 7/2015 Josypenko
2005/0078042 A1 * 4/2005 Chua ..... 343/746
2005/0233786 A1 * 10/2005 Hatch ..... G06F 1/1616 455/575.7

OTHER PUBLICATIONS

Yaghijian, Arthur D., and Stuart, Howard R., "Lower Bounds on the Q of Electrically Small Dipole Antennas", IEEE Transactions on Antennas and Propagation, vol. 58, No. 10, Oct. 2010.

* cited by examiner

*Primary Examiner* — Robert Karacsony
(74) *Attorney, Agent, or Firm* — SPAWAR Systems Center Pacific; Kyle Eppele; Ryan J. Friedl

(57) ABSTRACT

An apparatus includes an antenna element and a curved ground plane positioned beneath the antenna element. The antenna element has a height h and a first end with a tapered width, where h is approximately equal to the distance of a width-wise cross-sectional curve of the curved ground plane. The width of the curved ground plane is less than or equal to ½ h. A load may be positioned on top of a second end of the antenna element. The second end of the antenna element has a thickness greater than the first end and less than a thickness of the load. The curved ground plane may be substantially hemispherical in shape or may have a tapered height and increase in width from a first end to a second end.

11 Claims, 9 Drawing Sheets

TAPERED SLOT ANTENNA WITH A CURVED GROUND PLANE

CROSS-REFERENCE TO RELATED APPLICATIONS

This application is a continuation-in-part of U.S. patent application Ser. No. 13/926,725, filed on Jun. 25, 2013, entitled "Tapered Slot Antenna with Reduced Edge Thickness", the content of which is fully incorporated by reference herein.

FEDERALLY-SPONSORED RESEARCH AND DEVELOPMENT

The Tapered Slot Antenna with a Curved Ground Plane is assigned to the United States Government and is available for licensing for commercial purposes. Licensing and technical inquiries may be directed to the Office of Research and Technical Applications, Space and Naval Warfare Systems Center, Pacific, Code 72120, San Diego, Calif., 92152; voice (619) 553-5118; email ssc_pac_T2@navy.mil; reference Navy Case Number 101798.

BACKGROUND

A need exists for a compact tapered slot antenna that has improved low frequency performance.

DETAILED DESCRIPTION OF SOME EMBODIMENTS

Figure 1A:
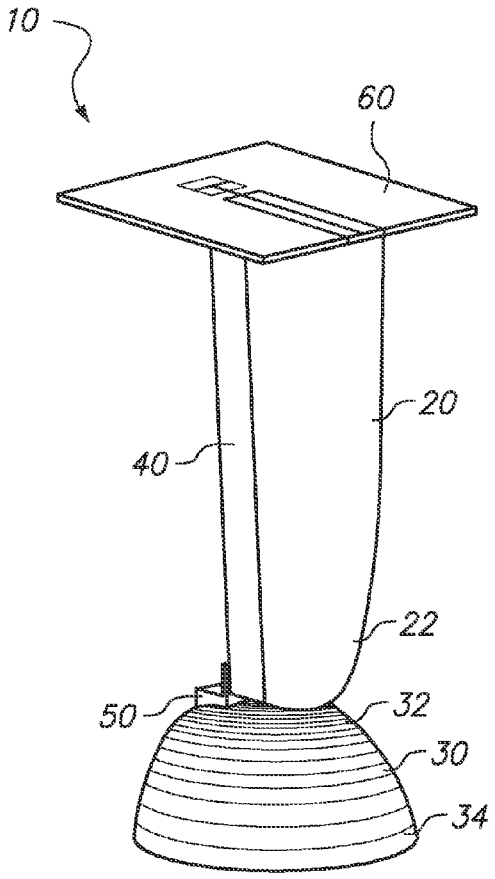
FIG. 1A shows a diagram of an embodiment of an apparatus in accordance with the Tapered Slot Antenna with a Curved Ground Plane.

Referring to FIGS. 1-2D, FIGS. 1A-1C show diagrams of an embodiment of a tapered slot antenna 10 in accordance with the Tapered Slot Antenna with a Curved Ground Plane. Antenna 10 includes an antenna element 20, a curved ground plane 30, supports 40 and 50, a load 60, and an RF feed connector 70. Antenna element 20 has a height h, a first end 22, a second end 24, a first side 26, a second side 28, and a thickness T, as shown in FIG. 2B. First side 26 and second side 28 define a width W of the antenna element. First side 26 is flat and second side 28 tapers from first end 22 to second end 24 such that first end 22 has a tapered width, as shown in FIG. 2A. As an example, height h is 48 inches. However, the dimension of h may vary depending upon the desired size and operating characteristics of antenna 10. First end 22 has a tapered width compared to second end 24, as illustrated in FIG. 2A. Various materials may be used for antenna element 20, such as aluminum and stainless steel.

The non-tapered edge of antenna element 20 is coupled to support 40, which is secured to curved ground plane 30 via support 50. As an example, antenna element 20 may be secured by fasteners (e.g. screws, nuts and bolts, etc. . . . ) to support 40 and support 50 may be secured to curved ground plane 30 by fasteners, with fasteners securing support 40 to support 50. Supports 40 and 50 may be made of any plastic non-conductive material with dialectric materials that approach one. For example, supports 40 and 50 may be made of a plastic material with a dielectric of approximately four.

Figure 2A:
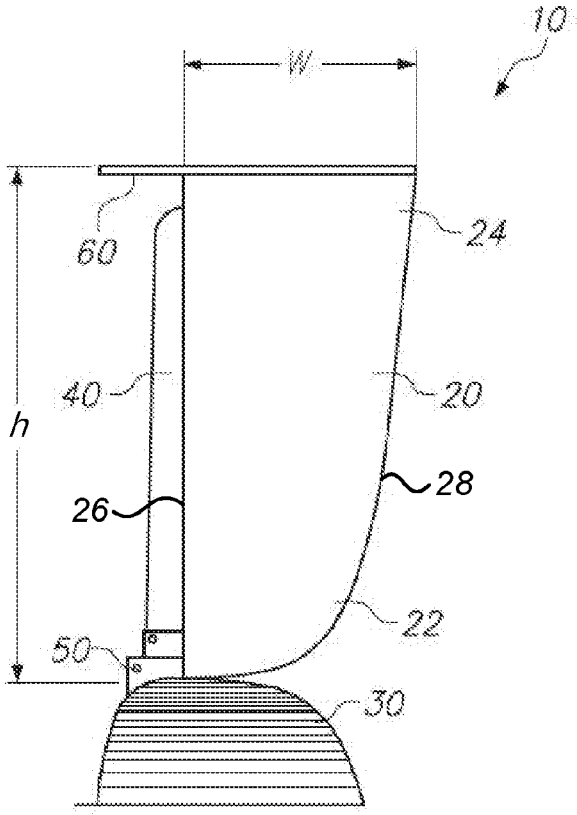
FIG. 2A shows a side view of the apparatus shown in FIG. 1A
Figure 2B:
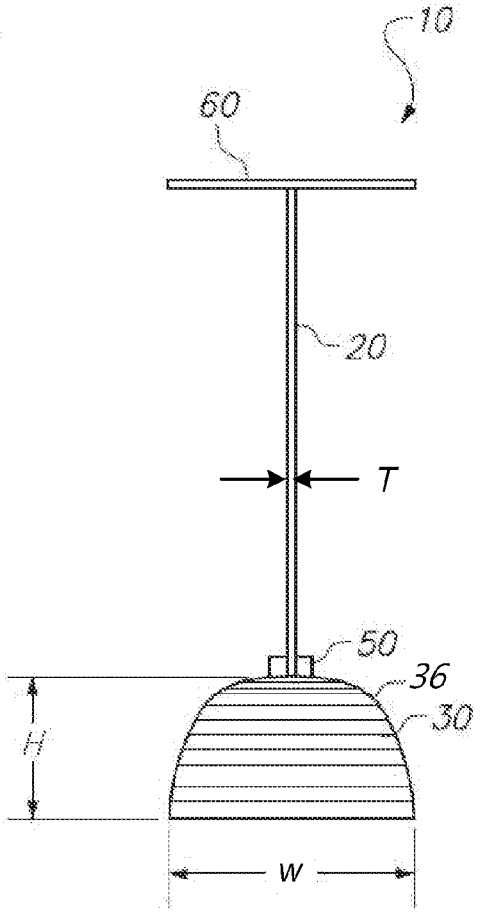
FIG. 2B shows a front view of the apparatus shown in FIG. 1A
Figure 2C:
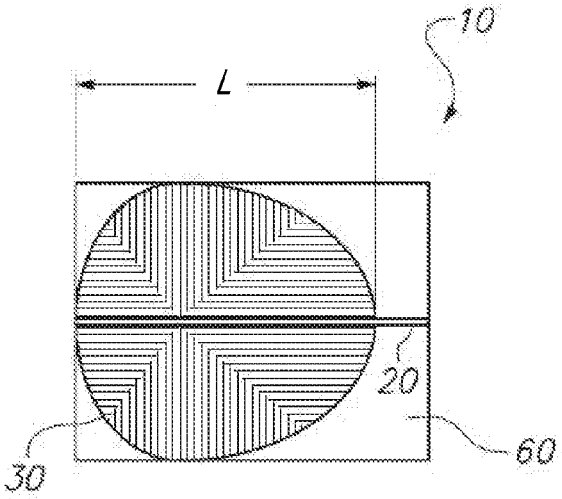
FIG. 2C shows a top view of the apparatus shown in FIG. 1A
Figure 2D:
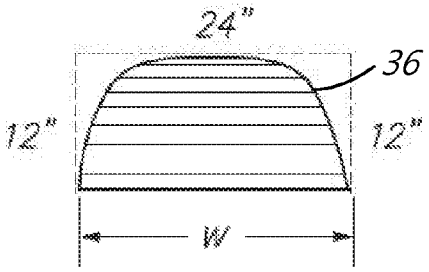
FIG. 2D shows a diagram illustrating the distance of a cross-section curve of a curved ground plane.

Curved ground plane 30 is positioned beneath first end 22. As shown, curved ground plane 30 is substantially hemispherical in shape, having a first end 32 and a second end 34. In some embodiments, a width w of the curved ground plane is less than or equal to ½ h. For example, width w may be equal to 24 inches. Further, as shown in FIG. 2B, the thickness T of antenna element 20 is less than width w of curved ground plane 30. In some embodiments, h is approximately equal to the distance of a cross-sectional curve taken along a width w of curved ground plane 30. For example, referring to FIG. 2D, the distance of a cross-section curve 36 of curved ground plane 30 is approximated in relation to the width (24 inches) and height (12 inches) of curved ground plane 30 to be about 48 inches. Accordingly, h would be approximately 48 inches, such as between 46 inches and 50 inches.

In some embodiments, the height of antenna 10 is approximately equal to twice the length L of curved ground plane 30. For example, if the length L of curved ground plane 30 is 30 inches, the height H of curved ground plane 30 is 12 inches, and height h is approximately 48 inches, the height of antenna 10 will be 60 inches.

Load 60 is positioned on top of second end 24 of antenna element 20. As an example, load 60 may comprise of a flat aluminum rectangular sheet that is 40 mm thick, 24 inches wide, and 30 inches long. Load 60 serves to "top load" antenna element 20. Top loading is generally used for antennas that are electrically small and present a low antenna radiation resistance at low frequencies. Such an antenna will require a capacitance at the feedpoint to tune out the inductive reactance. Employing a capacitance "hat" (e.g. load 60) will increase the overall capacitance of antenna element 20, resulting in a reduction in the capacitive reactance seen at the feedpoint. Therefore, at a given frequency, an antenna with top loading will require less inductance to tune it to resonance than the same length antenna without top loading. Further, top loading of antenna element 20 helps to increase the effective height of antenna 10.

Figure 1B:
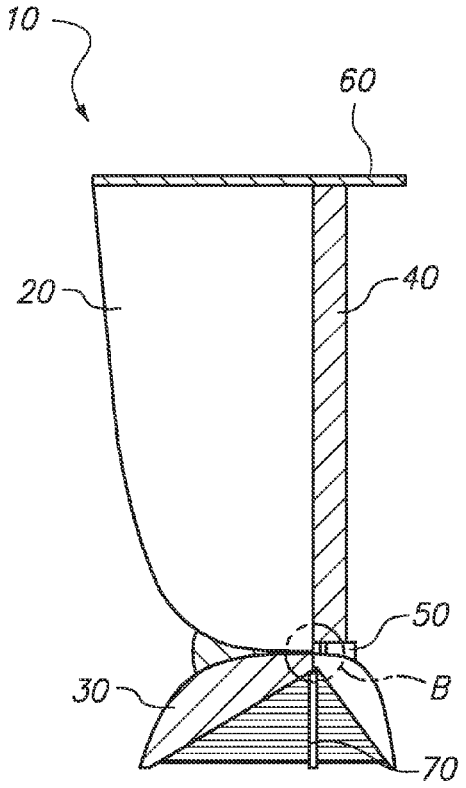
FIG. 1B shows a cross-section view of the apparatus shown in FIG. 1A
Figure 1C:
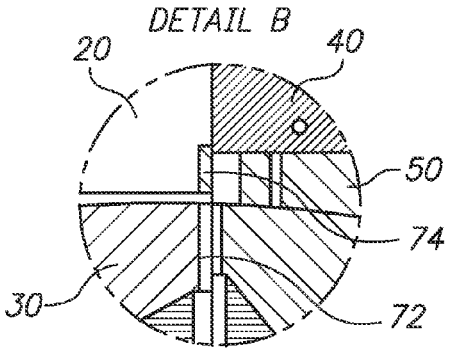
FIG. 1C shows a detailed view of the RF feed connector portion of the apparatus shown in FIG. 1A.

As shown in FIGS. 1B and 1C, antenna 10 may include an RF feed conductor 70 having an outer conductor portion 72 and an inner conductor portion 74. As an example, RF feed conductor 70 may be a flexible cable having a durable outer housing and an inner electrical wire. RF feed conductor 70 may be fed through the bottom of curved ground plane 30 up to antenna element 20. In such embodiments, outer conductor portion 72 may be coupled to curved ground plane 30 and inner conductor portion 74 may be electrically coupled to first end 22. As shown in FIG. 1C, inner conductor portion 74 is exposed to facilitate electrical connection to antenna element 20.

Antenna 10 may operate over a wide operating frequency band, such as between about 30 MHz and about 4 GHz. However, it should be recognized that varying the dimensions of antenna 10 will cause a change in the operating frequency band.

In theory, the ground plane for a monopole antenna is infinite, but ½ of an electrical wavelength at the lowest frequency performance of the antenna. By curving the ground plane, the surface area of the ground plane is increased and helps the performance of the antenna at lower frequencies, while maintaining performance at high frequency ranges. For example, antenna 10 may provide a gain of about −7 dBi to about 5 dBi for a frequency range of about 30 MHz to 300 MHz, while providing a gain of about 5 dBi to about 14 dBi for a frequency range of about 300 MHz to about 4 GHz. Additionally, antenna 10 may provide a maximum Voltage Standing Wave Ratio (VSWR) of 3.5 to 1 for a frequency range of about 30 MHz to about 150 MHz and a maximum VSWR of 2 to 1 for a frequency range of about 150 MHz to about 4 GHz. The bandwidth ratio provided by antenna 10 may be about 1000 to 1.

Figure 3:
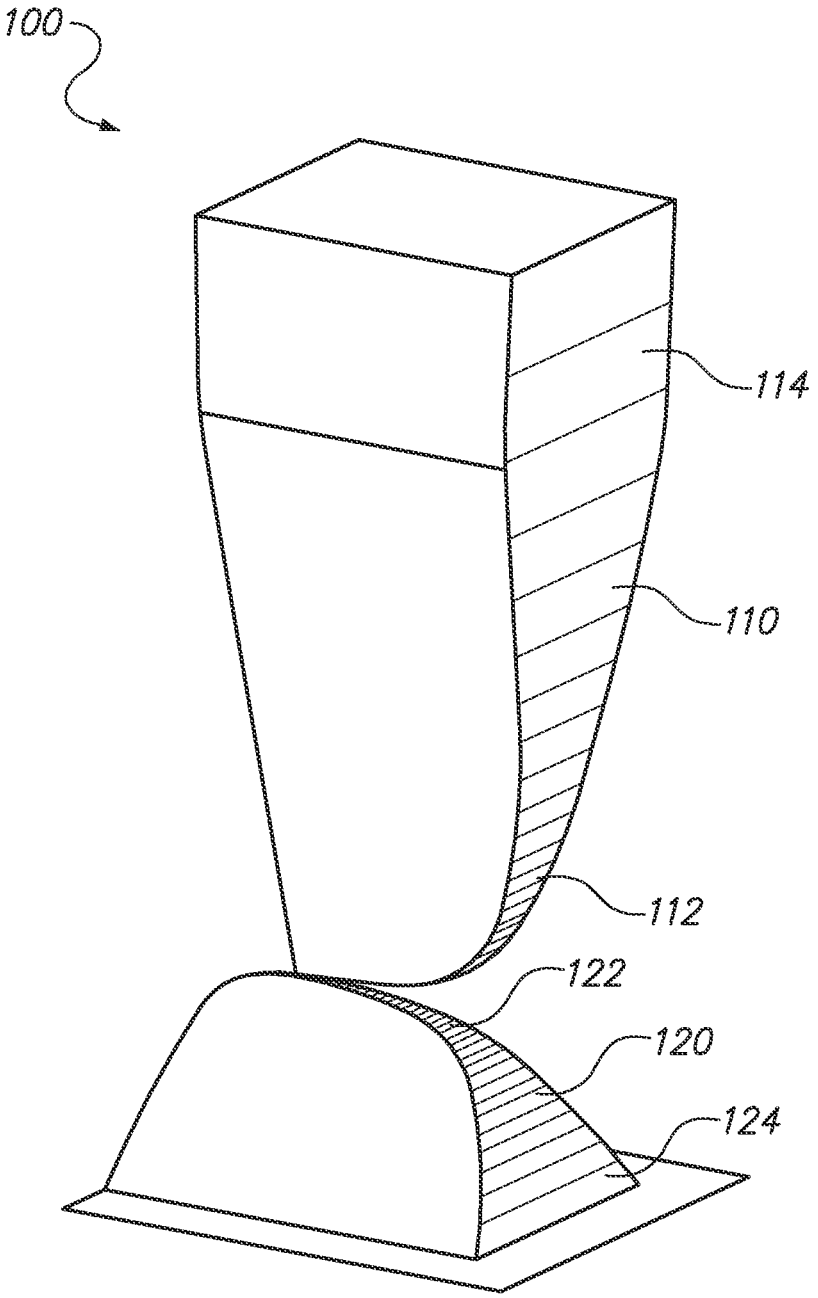
FIG. 3 shows a diagram of an embodiment of an apparatus in accordance with the Tapered Slot Antenna with a Curved Ground Plane.
Figure 4A:
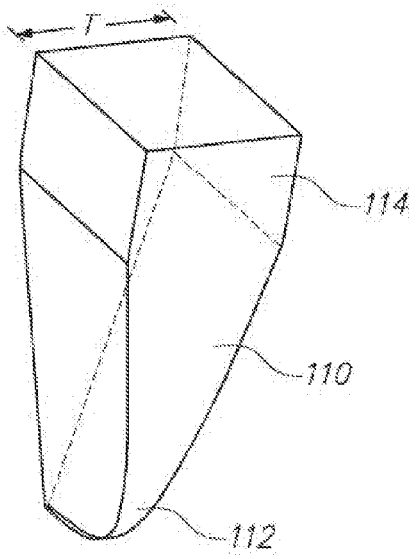
FIG. 4A shows an isometric view of the antenna element shown in FIG. 3.
Figure 4B:
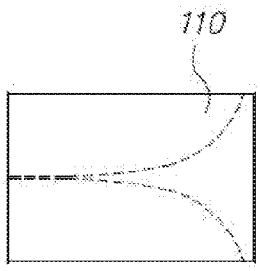
FIG. 4B shows a top view of the antenna element shown in FIG. 3
Figure 4C:
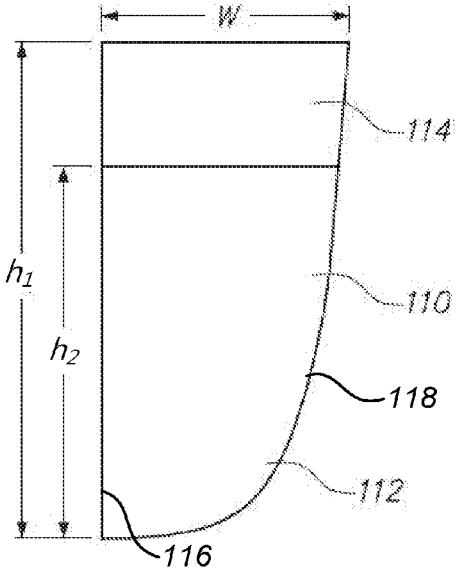
FIG. 4C shows a side view of the antenna element shown in FIG. 3
Figure 4D:
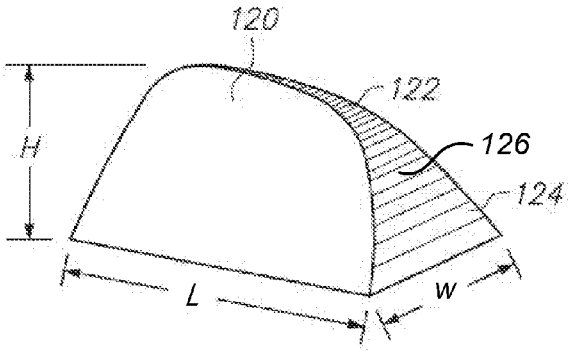
FIG. 4D shows an isometric view of the curved ground plane shown in FIG. 3.

Referring to FIGS. 3-4D, FIG. 3 shows a diagram of an embodiment of a tapered slot antenna 100 in accordance with the Tapered Slot Antenna with a Curved Ground Plane. Antenna 100 includes an antenna element 110 and a curved ground plane 120 positioned beneath antenna element 110. Antenna element 110 may be configured similarly as antenna element 20 shown in FIG. 1, including a first end 112 and a second end 114, with first end being tapered in relation to second end 114. Although not shown, antenna element 110 may be coupled to a support structure that is coupled to a connector which is connected to curved ground plane 120, similar to the configuration of antenna 10.

In addition to having a tapered width w, antenna element 110 has a tapered thickness t. In some embodiments, the thickness tapers gradually from second end 114, which may be defined as the end between distances $h_1$ and $h_2$, to first end 112. As shown, the thickness of second end 114 tapers gradually down to the thickness of first end 112, such that the thickness of first end 112 is less than the thickness of second end 114. In embodiments where antenna 100 includes a load (such as load 60 in FIG. 1) positioned on top of second end 114, the width of the load is greater than the thickness of second end 114.

As shown in FIG. 4D, curved ground plane 120 has a flat bottom surface and a top surface 126 that is curved lengthwise from one end to the other. Further, curved ground plane 120 has a tapered width, w, that increases in width from a first end 122 to a second end 124, as well as a height h and a length d. As shown in FIG. 3, first end 122 of curved ground plane 120 is aligned with first end 112 of antenna element 110 such that first end 122 and the curved top surface 126 of curved ground plane 120 form a tapered slot.

Figure 5:
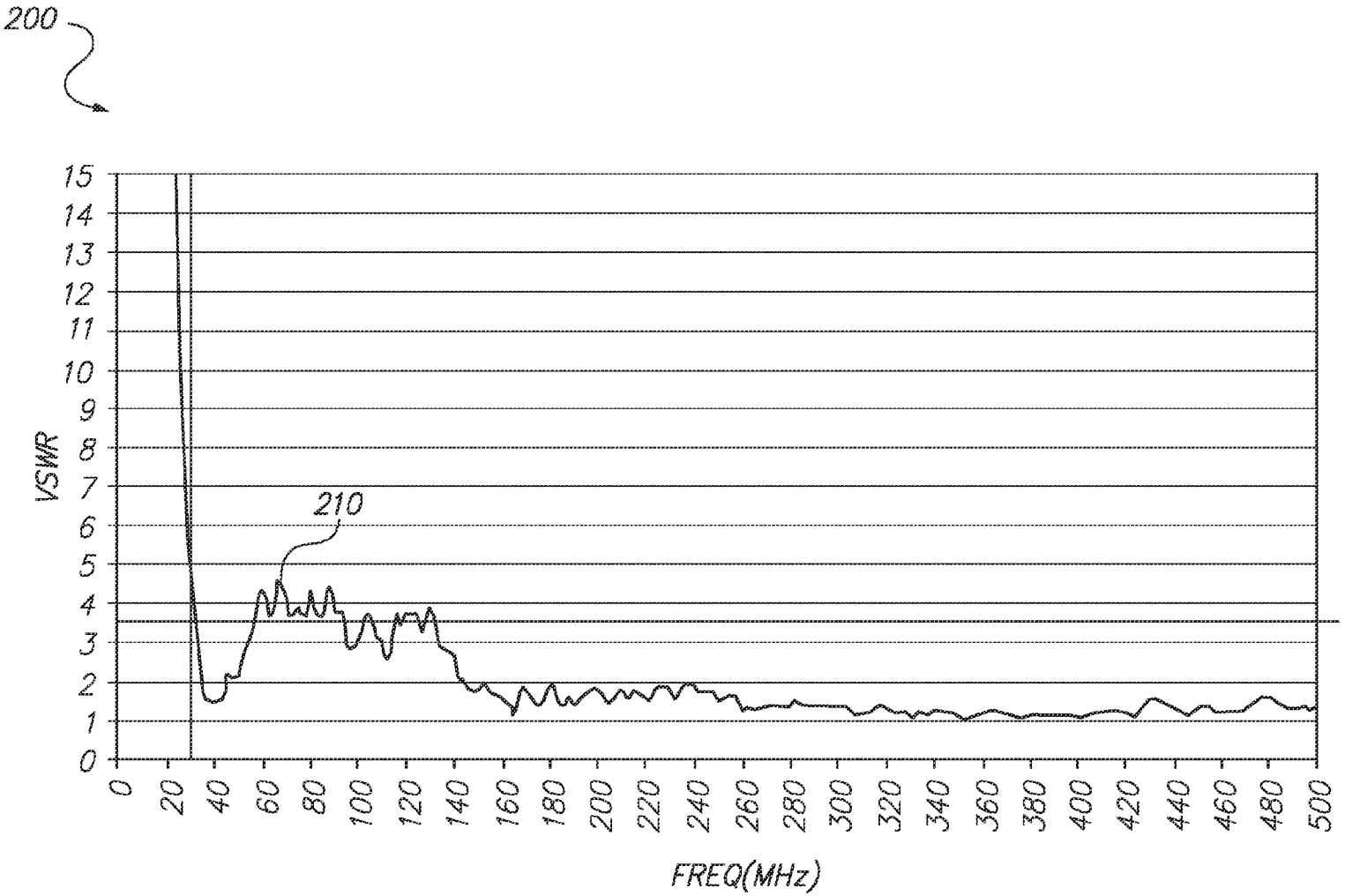
FIG. 5 shows a graph illustrating a low frequency band VSWR for an embodiment of the Tapered Slot Antenna with a Curved Ground Plane.

FIG. 5 shows a graph 200 illustrating a low frequency band (e.g. 30 MHz to 500 MHz) VSWR 210 for an embodiment of the Tapered Slot Antenna with a Curved Ground Plane. A Voltage Standing Wave Ratio of 2 translates into 90% of power transmitted to the antenna. A 3.5 VSWR translates into 70% of power transmitted to the antenna. For the entire bandwidth from 30 to 500 MHz the antenn VSWR is less than 3 and only 5 between 60 and 90 MHz. As shown in FIG. 5, a resonance frequency is shown at about 40 MHz with a VSWR less than 3. The curved ground plane in combination with the top load of the antenna lower the resonant frequency improving the performance of the antenna lower frequencies.

Figure 6:
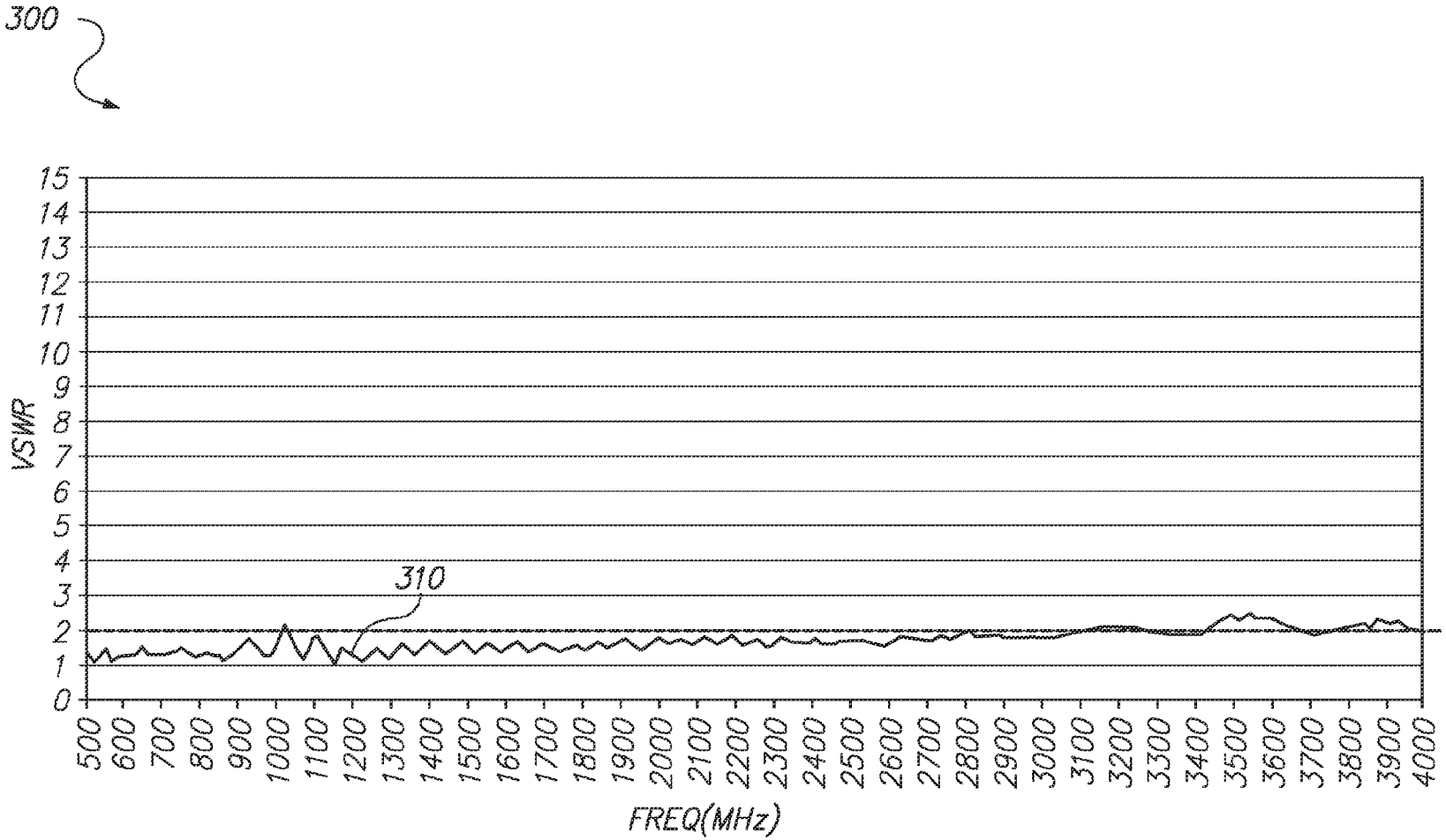
FIG. 6 shows a graph illustrating a high frequency band VSWR for an embodiment of the Tapered Slot Antenna with a Curved Ground Plane.
Figure 7:
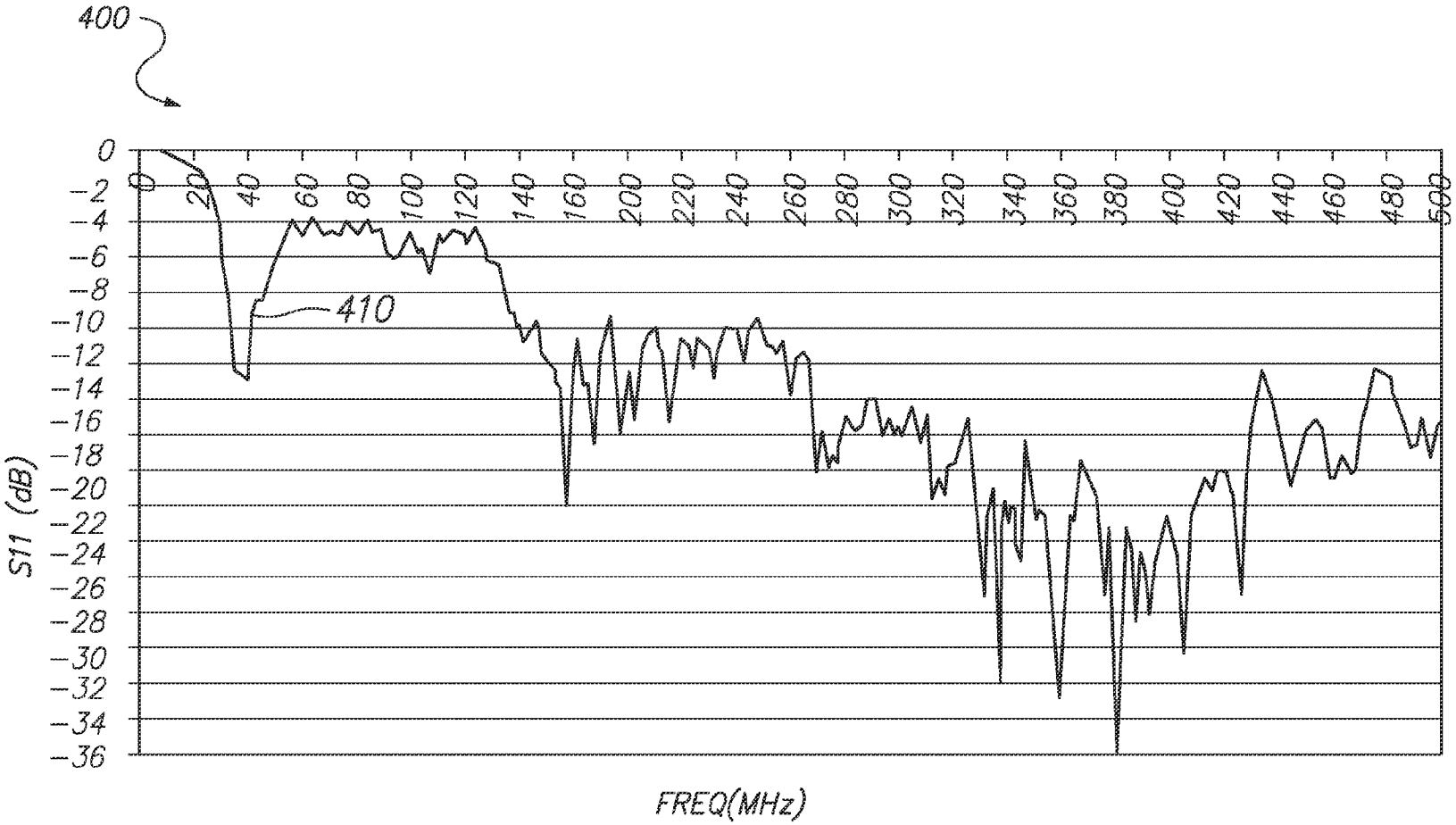
FIG. 7 shows a graph illustrating the return loss for an embodiment of the Tapered Slot Antenna with a Curved Ground Plane.

FIG. 6 shows a graph 300 illustrating a high frequency band (e.g. 500 MHz to 4 GHz) VSWR 310 showing the antenna still performs well at high frequencies with a VSWR of less than 3.5 throughout the entire shown frequency range. FIG. 7 shows a graph 400 illustrating the return loss 410. Return loss is a different way to observe antenna reflection performance in addition to VSWR. As seen in FIG. 7, the return loss 410 shows the lower resonant frequency at around 40 MHz. A return loss of −3 dB shows the antenna efficiency is 50%, a 10 dB return loss shows the antenna efficiency of 90%.

Figure 8:
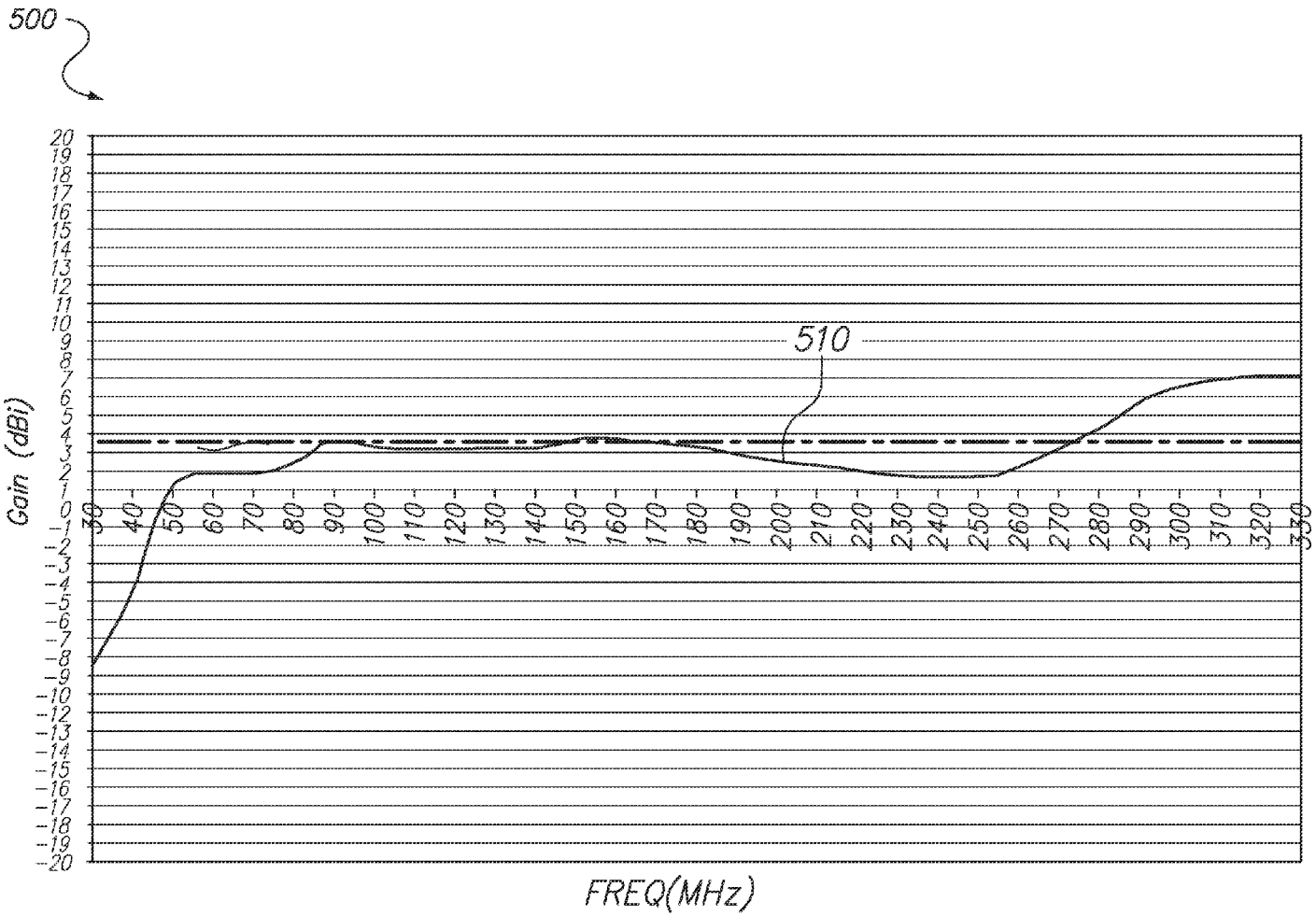
FIG. 8 shows a graph illustrating the gain versus a low frequency band for an embodiment of the Tapered Slot Antenna with a Curved Ground Plane.
Figure 9:
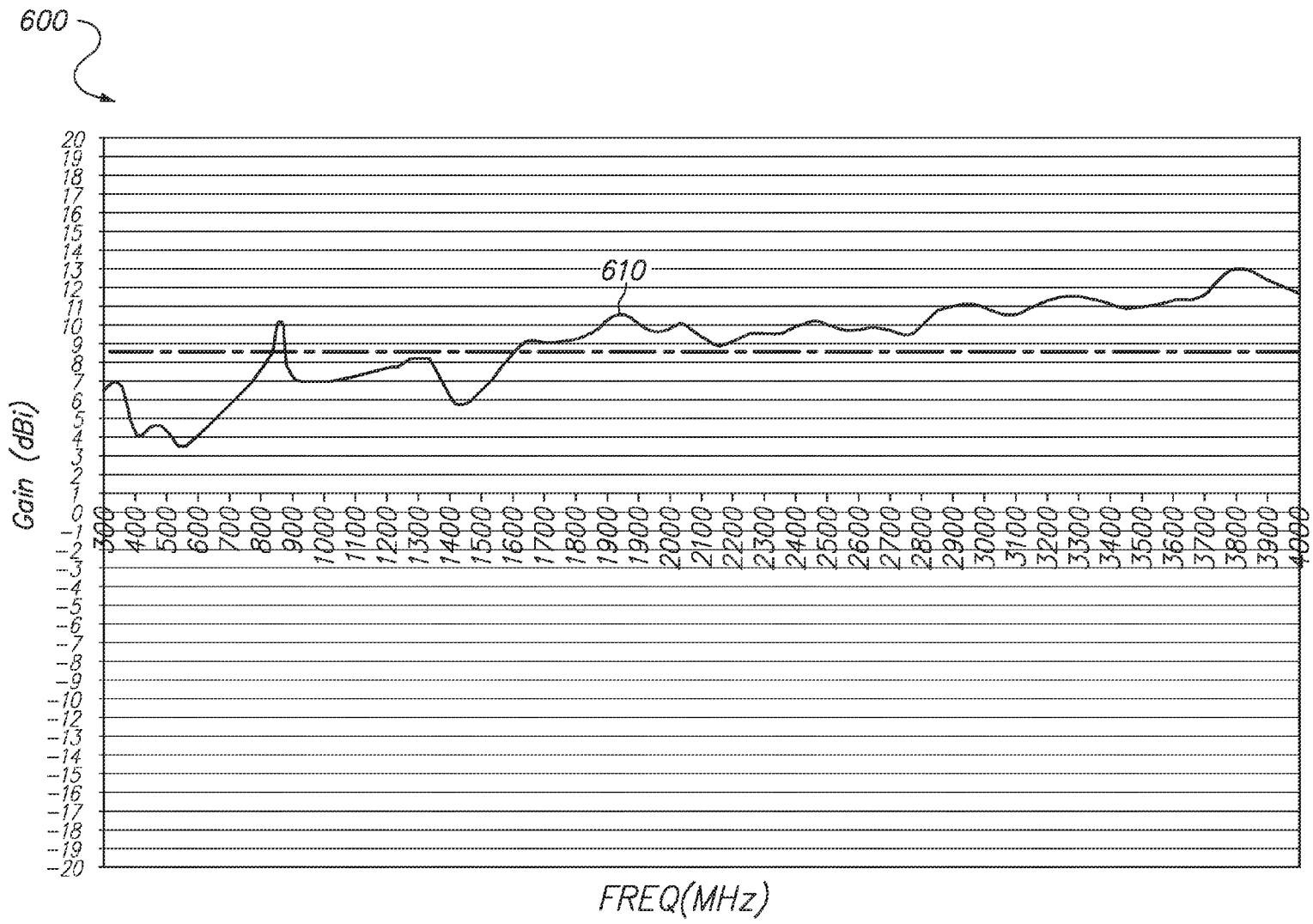
FIG. 9 shows a graph illustrating the gain versus a high frequency band for an embodiment of the Tapered Slot Antenna with a Curved Ground Plane.

FIG. 8 shows a graph 500 illustrating a plot 510 of the gain versus a low frequency band (e.g. 30 MHz to 500 MHz). As shown, the antenna gain of plot 510 increases as the frequency increase to a positive gain dBi. FIG. 9 shows a graph 600 illustrating a plot 610 of the gain versus a high frequency band (e.g. 500 MHz to 4 GHz) indicating the broadband antena performance gain showing an increasing gain throughout the entire frequency range.

Many modifications and variations of the Tapered Slot Antenna with a Curved Ground Plane are possible in light of the above description. Within the scope of the appended claims, the embodiments of the systems described herein may be practiced otherwise than as specifically described. The scope of the claims is not limited to the implementations and the embodiments disclosed herein, but extends to other implementations and embodiments as may be contemplated by those having ordinary skill in the art.

I claim:

1. An apparatus comprising:

an antenna element having a height h, a first side, a second side, a first end, a second end, and a thickness T, wherein the first side and the second side define a width W of the antenna element, wherein the first side is flat and the second side tapers from the first end to the second end such that the first end has a tapered width; and a curved ground plane positioned beneath the first end, wherein h is approximately equal to the distance of a cross-sectional curve taken along a width w of the curved ground plane, wherein the thickness T is less than the width w; and wherein the width w is less than or equal to ½ h; and wherein the curved ground plane is substantially hemispherical in shape; and wherein the antenna element and the curved ground plane form a tapered slot antenna.

2. The apparatus of claim 1 further comprising a load positioned on top of a second end of the antenna element.

3. The apparatus of claim 2, wherein the second end has a thickness greater than the thickness of the first end.

4. The apparatus of claim 3, wherein the thickness of the second end is less than a thickness of the load.

5. The apparatus of claim 1, wherein the curved ground plane has a tapered height and increases in width from a first end to a second end.

6. The apparatus of claim 5, wherein the first end of the curved ground plane is aligned with the first end of the Mot antenna element.

7. The apparatus of claim 1, wherein the slot antenna element is coupled to a vertical support secured to the curved ground plane.

8. The apparatus of claim 1 further comprising an RF feed conductor having an inner conductor portion and an outer conductor portion, wherein the RF feed conductor is fed through the bottom of the curved ground plane up to the antenna element, wherein the outer conductor portion is coupled to the curved ground plane and the inner conductor portion is electrically coupled to the first end of the curved ground plane.

9. An apparatus comprising:

an antenna element having a height h, a first side, a second side, a first end and a second end with a thickness greater than the thickness of the first end, wherein the first side and the second side define a width of the antenna element, wherein the first side is flat and the second side tapers from the first end to the second end such that the first end has a tapered width: and a curved ground plane positioned beneath the first end, wherein h is approximately equal to the distance of a cross sectional curve taken along a width w of the curved ground plane, wherein the width w is less than or equal to ½ h; and wherein the curved ground plane is substantially hemispherical in shape; and wherein the antenna element and the curved ground plane form a tapered slot antenna.

10. The apparatus of claim 9, wherein the curved ground plane has a tapered height.

11. The apparatus of claim 9 further comprising an RF feed conductor having an inner conductor portion and an outer conductor portion, wherein the RF feed conductor is fed through the bottom of the curved ground plane up to the antenna element, wherein the outer conductor portion is coupled to the curved ground plane and the inner conductor portion is electrically coupled to the first end of the curved ground plane.

* * * * *